US005878603A

United States Patent [19]

Warren, Jr. et al.

[11] Patent Number: 5,878,603

[45] Date of Patent: Mar. 9, 1999

[54] QUIET WATER FILL SYSTEM

[75] Inventors: Richard Edwin Warren, Jr., Schenectady; Robert Arvin Heeden, Clifton Park; Dennis Steenburgh, Caroga Lake, all of N.Y.

[73] Assignee: General Electric Company, Schenectady, N.Y.

[21] Appl. No.: 44,059

[22] Filed: Mar. 19, 1998

[51] Int. Cl.[6] ..... D06F 39/08

[52] U.S. Cl. ..... 68/207; 68/208; 134/56 D; 134/58 D; 134/57 D; 134/182; 137/216.1; 137/247.41

[58] Field of Search ..... 134/57 D, 56 D, 134/58 D, 182, 186, 155, 201; 68/207, 208, 13 R, 205 R; 137/216.1, 247.41

[56] References Cited

U.S. PATENT DOCUMENTS

| | | | |
|---|---|---|---|
| 1,909,336 | 5/1933 | Castle | 68/207 |
| 2,643,665 | 6/1953 | Stocking | 68/207 |
| 3,394,725 | 7/1968 | Macoicz | 68/207 |
| 3,508,571 | 4/1970 | Dutcher et al. | 68/207 |
| 3,717,168 | 2/1973 | Yake | 68/207 |
| 3,821,961 | 7/1974 | Schimke | 134/182 |
| 4,178,957 | 12/1979 | Hoffman et al. | 137/387 |
| 4,237,919 | 12/1980 | Crawford et al. | 137/216 |
| 4,467,627 | 8/1984 | Platt et al. | 68/207 |
| 5,259,219 | 11/1993 | Dausch et al. | 68/207 |
| 5,409,023 | 4/1995 | Santarossa et al. | 134/57 D |
| 5,487,528 | 1/1996 | Richmond | 251/127 |
| 5,503,172 | 4/1996 | Hedeen et al. | 134/183 |

FOREIGN PATENT DOCUMENTS

| | | | |
|---|---|---|---|
| 604415 | 10/1934 | Germany | 68/207 |
| 2825242 | 1/1979 | Germany | 68/207 |
| 54-127159 | 10/1979 | Japan | 68/207 |
| 61-265192 | 11/1986 | Japan | 68/207 |
| 368772 | 6/1963 | Switzerland | 68/207 |

*Primary Examiner*—Frankie L. Stinson
*Attorney, Agent, or Firm*—Patrick K. Patnode; Marvin Snyder

[57] ABSTRACT

A quiet fill water system for a washing machine comprises a washing tub having an outer wall and an entry port disposed within the outer wall and a valve having a water inlet and a water outlet. A water reservoir is coupled to the outer wall, the water reservoir having a tube entry port, a cup-shaped bottom portion and a water outlet wherein the water outlet is mated with the outer wall entry port so as to provide fluid communication between the water reservoir and the washing tub. A capillary tube having a first end, a second end and a tip portion is disposed such that the first end is coupled to the water outlet of the valve and the second end is positioned within the tube entry port so that the tip portion is disposed within the cup-portion of the water reservoir at a lower position relative to the water outlet such that a quiescent reservoir of water is formed during a fill period so as to decrease the level of noise of the fill period.

19 Claims, 2 Drawing Sheets

QUIET WATER FILL SYSTEM

BACKGROUND OF THE INVENTION

This invention relates to washing machines and more specifically to quiet water fill systems for washing machines.

Conventional washing machines, for example dishwasher machines, clothes washing machines and the like, wash articles in an internal washing tub. During the washing of these articles, the washing machines typically produce undesirable levels of noise. The "fill cycle," defined as the period the internal washing tub is filled with water, is a large contributor to the total noise levels of a washing cycle. There are two primary sources of noise during a fill cycle: valve noise; and tub noise. Valve noise results from water passing through the water entry valve, coupled with a high pressure drop across the valve that causes cavitation and related noise. Tub noise results from water directly entering the washing tub at a relatively high flowrate, colliding with the wall of the washing tub.

Therefore, it is apparent from the above that there is a need in the art for a quiet water fill system for washing machines.

SUMMARY OF THE INVENTION

A quiet fill water system for a washing machine comprises a washing tub having an outer wall and an entry port disposed within the outer wall and a valve having a water inlet and a water outlet. In one embodiment, a water reservoir is coupled to the outer wall, the water reservoir having a tube entry port, a cup-shaped bottom portion and a water outlet wherein the water outlet is mated with the outer wall entry port so as to provide fluid communication between the water reservoir and the washing tub. A capillary tube having a first end, a second end and a tip portion is disposed such that the first end is coupled to the water outlet of the valve and the second end is positioned within the tube entry port so that the tip portion is disposed within the cup-portion of the water reservoir at a lower position relative to the water outlet such that a quiescent reservoir of water is formed during a fill period so as to decrease the level of noise of the fill period.

DETAILED DESCRIPTION OF THE INVENTION

Figure 1:
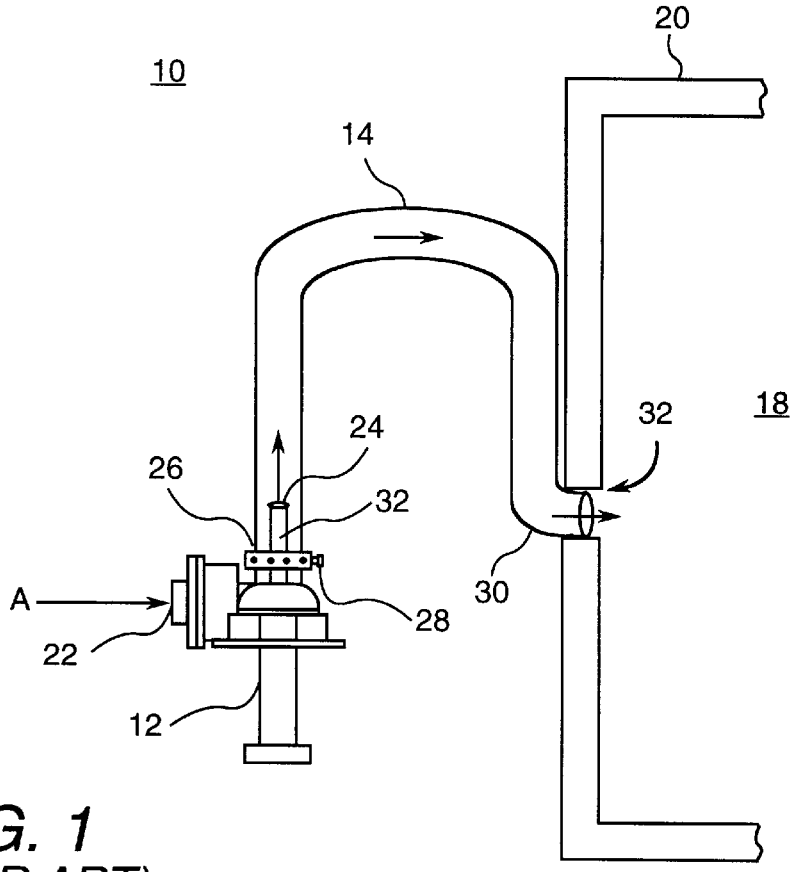
FIG. 1 (PRIOR ART)
FIG. 1 is a schematic side elevation cross-sectional view of a prior art washing machine fill system.

A washing machine 10 comprising a valve 12, a conventional fill hose 14 and a washing tub 18, which washing tub 18 is defined by an outer wall 20, is shown in FIG. 1.

Valve 12 comprises a water inlet 22 and a water outlet 24. Water inlet 22 is disposed in flow communication with a source of water (not shown) and water outlet 24 is coupled to a first end 26 of fill hose 14 by a hose clamp 28 or the like. A second end 30 of fill hose 14 is disposed within an entry port 32 in wall 20 of washing tub 18.

Valve 12 is movable between a fully open position, in which water is permitted to flow from a high-pressure water source (generally along arrow "A" of FIG. 1) through valve 12 to fill hose 14 and a fully closed position in which water is not permitted to flow.

The flowrate of the water is controlled by a restricted flow area 32 of valve 12 such as an orifice or the like. Restricted flow area 32 is a source of noise in conventional valves because the pressure drop across restricted flow area 32 is high, creating cavitation and resulting noise.

Figure 2:
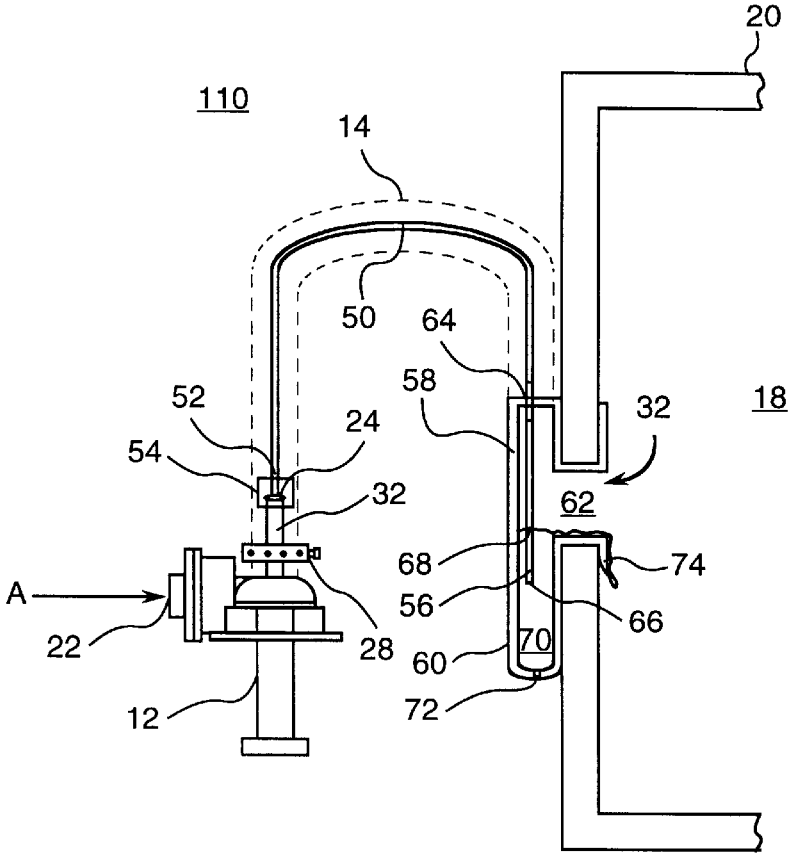
FIG. 2 is a schematic side elevation cross-sectional view of one embodiment of the instant invention.

In accordance with one embodiment of the instant invention, an inter-connecting capillary tube 50 is disposed so as to reduce noise within a quiet fill washing machine 110 by eliminating the cavitation of valve 12, as shown in FIG. 2. Capillary tube 50 provides a back pressure to reduce the pressure drop across the restricted flow area 32 of valve 12. Capillary tube 50 then distributes the pressure drop along the length of capillary tube 50. The diameter and length of capillary tube 50 are selected so as to reduce the pressure drop across restricted flow area 32 of valve 12, while maintaining a suitable water flowrate. Capillary tube 50 can be retro-fit within conventional washing machines by positioning capillary tube 50 within a conventional fill hose 14 (see fill hose 14 shown in phantom in FIG. 2) or alternatively capillary tube 50 can replace fill hose 14 altogether. In one embodiment of the instant invention, the diameter (D) of capillary tube 50 is in the range between about 0.075 in. to about 0.170 in. In one embodiment of the instant invention, the length (L) of capillary tube 50 is in the range between about 6 inches to about 24 inches.

Water outlet 24 of valve 12 is directly coupled to a first end 52 of inter-connecting capillary tube 50. In an alternative embodiment, water outlet 24 is disposed in a spaced relation with first end 52 of capillary tube 50 and an additional fitting 54 is provided between water outlet 24 and capillary tube 50 to provide a coupling therebetween.

A second end 56 of inter-connecting capillary tube 50 is disposed within a water reservoir 58.

Water reservoir 58 comprises a cup-shaped body portion 60, a water flow port 62 mated with substantially equally sized opening 32 in wall 20 of washing tub 18, and a tube entry port 64. Second end 56 of inter-connecting capillary tube 50 is positioned within tube entry port 64 such that a tip portion 66 of capillary tube 14 is disposed lower than a water level 68 (during fill cycles) of a quiescent reservoir 70 of water within cup-shaped body portion 30.

During a fill cycle of washing machine 10, valve 12 is disposed in an open position permitting water to flow from water source through valve 12 to inter-connecting capillary tube 50

When compared to conventional fill hose 14 the flow through capillary tube 50 is relatively constant and the diameter is significantly smaller. Accordingly, the velocity of the water exiting capillary tube 50 is greater than that of conventional fill hose 14. If the high-speed water flow exiting capillary tube 50 were allowed to flow directly to tub 18, excessive noise would be created by the high-speed water jet impinging wall 20 of tub 18.

Accordingly, in order to avoid excessive noise created by the high-speed jet of water within capillary tube 50, the velocity of the flow must be reduced in a relatively confined space.

In accordance with another embodiment of the instant invention, water reservoir 58 reduces the velocity of the water exiting through tip portion 66 of capillary tube 50 by creating a quiescent reservoir 70 into which high-speed water exiting capillary tube 50 dissipates. As discussed above, cup-shaped body portion 60 of water reservoir 58 is inverted with respect to water flow such that a portion of water flow is captured within cup-shaped body portion 60 forming a quiescent reservoir 70 of water to fill level 68. Tip portion 66 of capillary tube 50 is disposed below the fill level 68 of quiescent reservoir 70 such that exiting high velocity water enters quiescent reservoir 70 in a smooth dissipating flow. As the level of water rises above fill level 68 within cup-shaped body portion 60 of water reservoir 58, a proportional volume of water exits quiescent reservoir 70 through water flow port 62 into tub 18. If codes require an air break between fresh and gray water, a bleed hole 72 is provided at a low point of cup-shaped body portion 60 to allow quiescent reservoir 70 to slowly drain after a wash cycle is completed. The shape and design of reservoir 58 are chosen to minimize splash noise and to fit into opening 32 within wall 20 where conventional fill hose 14 is typically attached (See FIG.1).

In one embodiment of the instant invention, the exit of reservoir 58 further comprises a lip 74 contoured to permit water to gently transition down wall 20 of tub 18 so as to reduce splash noise.

Figure 3:
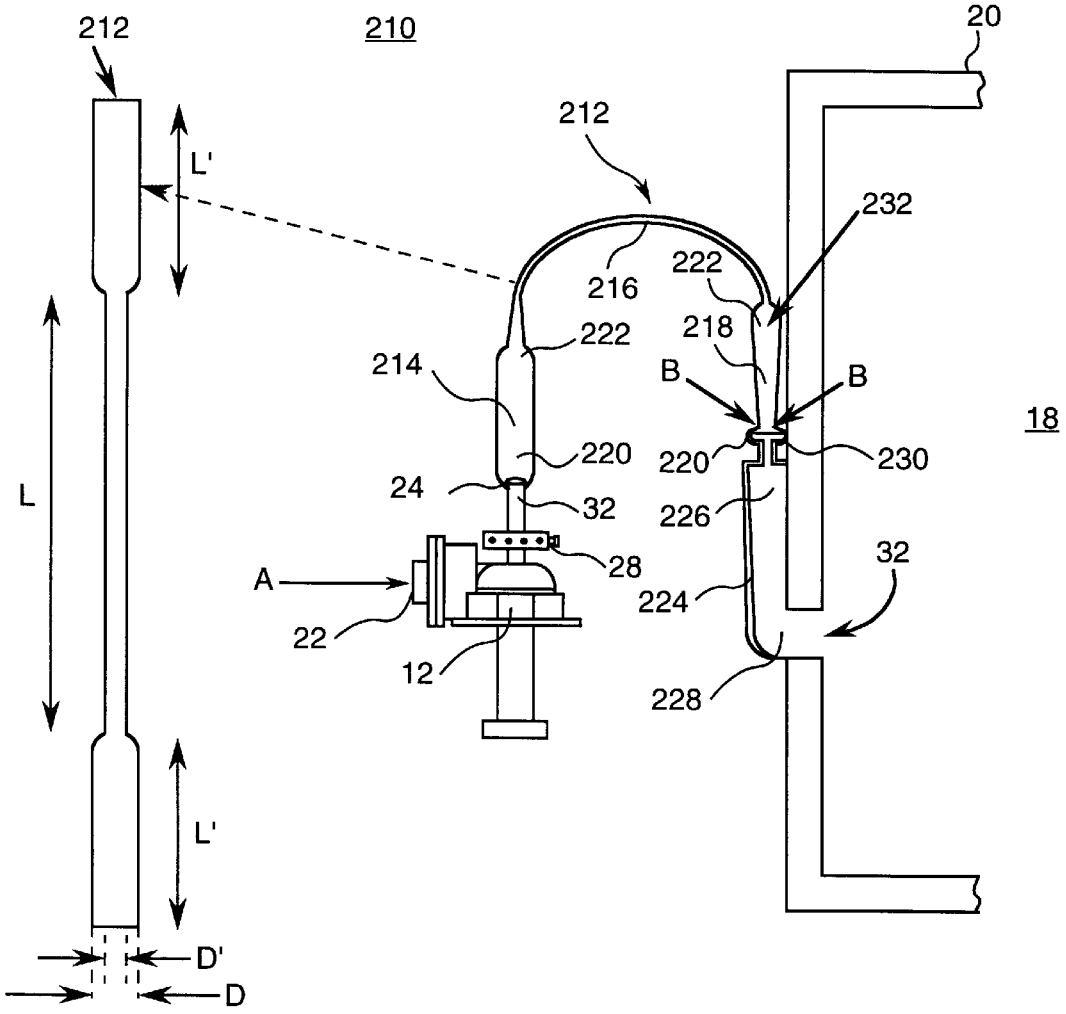
FIG. 3 is a schematic side elevation cross-sectional view of another embodiment of the instant invention.

In an alternative embodiment of the instant invention, a quiet fill water system 210 is shown in FIG. 3. Quiet fill water system 210 comprises valve 12 and washing tub 18, which washing tub 18 is defined by outer wall 20.

In accordance with another embodiment of the instant invention, second attachment socket 218 is coupled to a mounting nipple 230 at the entrance of fill funnel 224. The outside diameter of mounting nipple 230 is substantially equally sized with the inside diameter of attachment socket 218 or alternatively the outside diameter of attachment nipple 230 is slightly larger, typically about 0.03125 to about 0.0625 inches larger than the inside diameter of attachment socket 218. When second attachment socket 218 is fitted onto mounting nipple 230, the sides of attachment socket 218 adjacent the edge of nipple 230 pinch-in slightly (see arrows "B" in FIG. 3), creating a small flow restriction. This flow restriction creates a small increase in pressure at this interface causing the water (during a fill cycle) to fill up second attachment socket 218 creating a quiescent reservoir 232 within attachment socket 218 such that exiting high velocity water enters quiescent reservoir 232 in a smooth dissipating flow so as to minimize flow noise.

EXAMPLE 1

| VALVE | PSIG @ 120° F. | GALLONS/MIN | NOISE IN dbA AT 24 INCHES |
|---|---|---|---|
| STANDARD VALVE WITH STANDARD FILL HOSE | 65 | 1.6 | 67.5 |
| STANDARD VALVE WITH CAPILLARY TUBE | 65 | 1.7 | 50 |

An interconnecting capillary tube 212 comprises a first large diameter attachment socket 214, an interconnecting reduced diameter tubing 216 and a second large diameter attachment socket 218. Each attachment socket 214, 218 is generally beaker-shaped having a large diameter open-end 220 and a transitioning necked down portion 222. Interconnecting capillary tube 212 is disposed so as to reduce noise within quiet fill water system 210 by limiting the cavitation of valve 12. First attachment socket 214 is fitted over restricted flow area 32 of valve 12. Reduced diameter tubing 216 provides a back pressure to reduce the pressure drop across restricted flow area 32 of valve 12 while maintaining a suitable water flow rate.

In one embodiment of the instant invention, the diameter (D) of each attachment socket 214, 218 at open end 220 is in the range between 0.3125 inches to about 0.625 inches and the length (L) of each attachment socket 214, 218 is in the range between about 3 inches to about 4 inches. In one embodiment of the instant invention, the diameter (D') of interconnecting reduced diameter tubing 216 is in the range between 0.075 inches and 0.170 inches and the length (L') of interconnecting reduced diameter tubing 216 is in the range between about 6 inches to about 18 inches.

A fill funnel 224 is disposed on wall 20 of washing tub 18. Fill funnel 224 is generally J-shaped having a straight tube portion 226 longitudinally disposed at wall 20 and a curved bottom portion 228 that is mated with opening 32 in wall 20 of washing tub 18. In this arrangement, water exits capillary tube 212 and enters fill funnel 224 through straight tube portion 226 and curved bottom portion 228 into washing tub 18.

In order to avoid excessive noise created by a highspeed jet of water exiting capillary tube 212, the velocity of the flow must be reduced in a relatively confined spaced.

As an example of the effectiveness of the instant invention, a series of tests to gauge the performance of the quiet fill system were conducted. The flowrate and noise level, at 65 psig, were measured using both a conventional fill hose and a capillary tube. The conventional fill hose was 24 inches long and had an inside diameter of 0.313 inches and the capillary tube was 24 inches long with an inside diameter of 0.125 inches. Although flow rates are similar, as desired, the noise emitted by the quiet fill system is more than 17 dBA quieter.

While only certain features of the invention have been illustrated and described, many modifications and changes will occur to those skilled in the art. It is, therefore, to be understood that the appended claims are intended to cover all such modifications and changes as fall within the true spirit of the invention.

What is claimed is:

1. A quiet fill water system for a washing machine comprising:

a washing tub having an outer wall and an entry port disposed within said outer wall;

a valve having a water inlet and a water outlet;

a water reservoir coupled to said outer wall, said water reservoir having a tube entry port, a cup-shaped bottom portion and a water flow port wherein said water flow port is mated with said outer wall entry port so as to provide fluid communication between said water reservoir and said washing tub; and a capillary tube having a first end, a second end and a tip portion wherein said first end is coupled to said water outlet of said valve and said second end is positioned within said tube entry port so that said tip portion is disposed within said cup-portion of said water reservoir at a lower position relative to said water flow port such that a quiescent reservoir of water is formed during a fill period so as to decrease the level of noise of said fill period.

2. A quiet fill water system in accordance with claim 1, wherein said washing machine is a dishwasher.

3. A quiet fill water system in accordance with claim 1, wherein said washing machine is a clothes washing machine.

4. A quiet fill water system in accordance with claim 1, wherein said capillary tube has a diameter in the range between about 0.075 in. to about 0.170 in.

5. A quiet fill water system in accordance with claim 1, wherein said capillary tube has a length in the range between about 6 inches to about 24 inches.

6. A quiet fill water system in accordance with claim 1, wherein said water reservoir further comprises a contoured lip that extends from said water outlet into said washing tub so as to transition water flow therein.

7. A conventional washing machine having a washing tub having an outer wall and an entry port disposed within said outer wall, a valve having a water inlet and a water outlet and a fill hose connected at a first end to said water outlet of said valve and at a second end to said entry port of said outer wall; the improvement comprising:

a water reservoir coupled to said outer wall, said water reservoir having a tube entry port, a cup-shaped bottom portion and a water flow port wherein said water flow port is mated with said outer wall entry port so as to provide fluid communication between said water reservoir and said washing tub; and a capillary tube having a first end, a second end and a tip portion wherein said first end is coupled to said water outlet of said valve and said second end is positioned within said tube entry port so that said tip portion is disposed within said cup-portion of said water reservoir at a lower position relative to said water flow port such that a quiescent reservoir of water is formed during a fill period so as to decrease the level of noise of said fill period.

8. A quiet fill water system in accordance with claim 7, wherein said washing machine is a dishwasher.

9. A quiet fill water system in accordance with claim 7, wherein said washing machine is a clothes washing machine.

10. A quiet fill water system in accordance with claim 7, wherein said capillary tube has a diameter in the range between about 0.075 inches to about 0.170 inches.

11. A quiet fill water system in accordance with claim 7, wherein said capillary tube has a length in the range between about 6 inches to about 24 inches.

12. A quiet fill water system in accordance with claim 7, wherein said water reservoir further comprises a contoured lip that extends from said water outlet into said washing tub so as to transition water flow therein.

13. A quiet fill water system for a washing machine comprising:

a washing tub having an outer wall and an entry port disposed within said outer wall;

a valve having a water inlet and a water outlet;

a fill funnel coupled to said outer wall, said fill funnel having a straight tube portion, a curved bottom portion and a mounting nipple wherein said curved bottom portion is mated with said outer wall entry port so as to provide fluid communication between said fill funnel and said washing tub; and a capillary tube having a first attachment socket, a second attachment socket and an interconnecting reduced diameter tubing wherein said first attachment socket is coupled to said water outlet of said valve and said second attachment socket is coupled to said mounting nipple of said fill funnel such that the sides of said second attachment socket pinch-in about said nipple creating a flow restriction that causes a quiescent reservoir of water to form within said second attachment socket during a fill period so as to decrease the level of noise of said fill period.

14. A quiet fill water system in accordance with claim 13, wherein the diameter of said attachment socket at an open-end is in the range between about 0.3125 inches to about 0.65 inches.

15. A quiet fill water system in accordance with claim 13, wherein the length of said attachment socket is in the range between about three inches to about 4 inches.

16. A quiet fill water system in accordance with claim 13, wherein the diameter of said reduced diameter tubing is in the range between about 0.075 inches to about 0.170 inches.

17. A quiet fill water system in accordance with claim 13, wherein the length of said reduced diameter tubing is in the range between about 6 inches to about 18 inches.

18. A quiet fill water system in accordance with claim 13, wherein the outside diameter of said mounting nipple is substantially equally sized with said inside diameter of said attachment socket.

19. A quiet fill water system in accordance with claim 13, wherein the outside diameter of said mounting nipple is in the range between about 0.03125 inches to about 0.065 inches larger than the inside diameter of said attachment socket.

* * * * *